US005811939A

United States Patent [19]

Herniak

[11] Patent Number: 5,811,939

[45] Date of Patent: Sep. 22, 1998

[54] BI-LEVEL CONTROL SYSTEM FOR LIGHTING AND OTHER APPLICATIONS

[76] Inventor: Edward Herniak, 100 Riverbend Dr., P.O. Box 821, Amherst Nova Scotia, Canada, B4H 4B9

[21] Appl. No.: 772,942

[22] Filed: Dec. 24, 1996

[51] Int. Cl.[6] ..... H05B 37/00

[52] U.S. Cl. ..... 315/313; 315/360; 315/362; 307/113; 307/139

[58] Field of Search ..... 315/226, 240, 315/313, 362, 360, 291, DIG. 4, 294, 295, 312, 320, 322, 321; 307/112, 113, 125, 126, 139, 140

[56] References Cited

U.S. PATENT DOCUMENTS

| | | | |
|---|---|---|---|
| 4,931,701 | 6/1990 | Carl | 315/240 |
| 5,212,478 | 5/1993 | Moseley | 340/825.72 |
| 5,221,877 | 6/1993 | Falk | 315/291 |
| 5,309,068 | 5/1994 | Hakkarainen et al. | 315/362 |
| 5,327,048 | 7/1994 | Troy | 315/240 |
| 5,357,170 | 10/1994 | Luchaco et al. | 315/159 |
| 5,450,302 | 9/1995 | Maase et al. | 362/276 |
| 5,610,448 | 3/1997 | Dattilo | 307/39 |
| 5,633,540 | 5/1997 | Moan | 307/126 |

FOREIGN PATENT DOCUMENTS 2123226 5/1993 Canada .

*Primary Examiner*—Benny Lee
*Assistant Examiner*—David H. Vu
*Attorney, Agent, or Firm*—Neil Teitelbaum & Associates

[57] ABSTRACT

A circuit and method for switching an output terminal from a first voltage level to a second voltage level through a buffered transition includes two voltage sources, a resistor and first switch connected in series and electrically coupled between the first voltage source and the output terminal for providing a suitable resistance for buffering a transition from a first voltage level to a second voltage level. A second switch is electrically coupled between the first voltage and the output terminal. A third switch is electrically coupled between the second voltage source and the output terminal. A programmable logic controller (PLC) controls the three switches in a predetermined sequence to allow switching a voltage source from the first source to the second source through a buffered transition provided by the resistor.

10 Claims, 3 Drawing Sheets

BI-LEVEL CONTROL SYSTEM FOR LIGHTING AND OTHER APPLICATIONS

FIELD OF THE INVENTION

This invention relates to a bi-level control system for operating high intensity discharge (HID) lamps at a first light output level and a second reduced light output level and more particularly, to providing an inexpensive efficient circuit and method for regulating power supplied to these lamps or other non-interruptible or similar type loads.

BACKGROUND OF THE INVENTION

Lighting Controllers are important tools available in energy management. Through programmed time schedule and automatic variable dimming, significant energy savings can be achieved. Correctly designed and implemented, lighting controllers can achieve, in some instances, average savings of 10–15%. Lighting controllers are designed to provide high voltage supply to lighting panels under certain conditions and to provide low voltage supply to lighting panels under other conditions.

Complex, bulky, relatively expensive systems for controlling high intensity discharge (HID) lamps are known. For example, Falk in U.S. Pat. No. 5,221,877 teaches a system wherein two switches are actuated substantially simultaneously in each half-cycle of the A.C. power input, once for power reduction for a time interval T1–T2 and once for harmonic distortion reduction for a time T3–T4 that encompasses each A.C. power zero-crossing time TX. Another system is described in U.S. Pat. No. 5,327,048 in the name of Troy wherein a plurality of slave units are provided, each slave unit comprising a switched capacitor and a slave relay. Although these systems may perform their intended purpose, they are complex and relatively expensive to manufacture.

In accordance with this invention, a simple, relatively compact, light weight, inexpensive control system is provided for controlling HID lamps and other loads, wherein bi-level switching for dimming is required. The system comprises: a first voltage source for providing a first voltage level; a second voltage source for providing a second voltage level; resistive means and first switching means in series and electrically coupled between the first voltage source and the output terminal for providing a suitable resistance for buffering a transition from the first voltage level to the second voltage level; a second switching means electrically between the first voltage and the output terminal; a third switching means electrically between the second voltage source and the output terminal; control means for controlling the three switches in a predetermined sequence to allow switching a voltage source from the first source to the second source through a buffered transition provided by the resistive means.

In accordance with yet another aspect of the invention a method for switching an output terminal from a first voltage level to a second level through a buffered transition is provided, comprising the steps of:

a) providing a first voltage source for providing a first voltage level;

b) providing a second voltage source for providing a second voltage level;

c) electrically coupling the first voltage source to the output terminal to provide the first voltage level at the output terminal;

d) after a suitable duration for warming up a load, buffering a transition from the first voltage level to the second voltage level by switching resistive means into the circuit between the first voltage source and the output terminal, and allowing current to pass through the resistive means for a predetermined interval of time while decoupling the first voltage source from being directly coupled to the output terminal; and, e) switching to electrically couple the second voltage source to the output terminal to provide the second voltage level at the output terminal.

BRIEF DESCRIPTION OF THE DRAWINGS

Exemplary embodiments of the invention will now be described in accordance with the invention, in which.

DETAILED DESCRIPTION OF THE INVENTION

Figure 1:
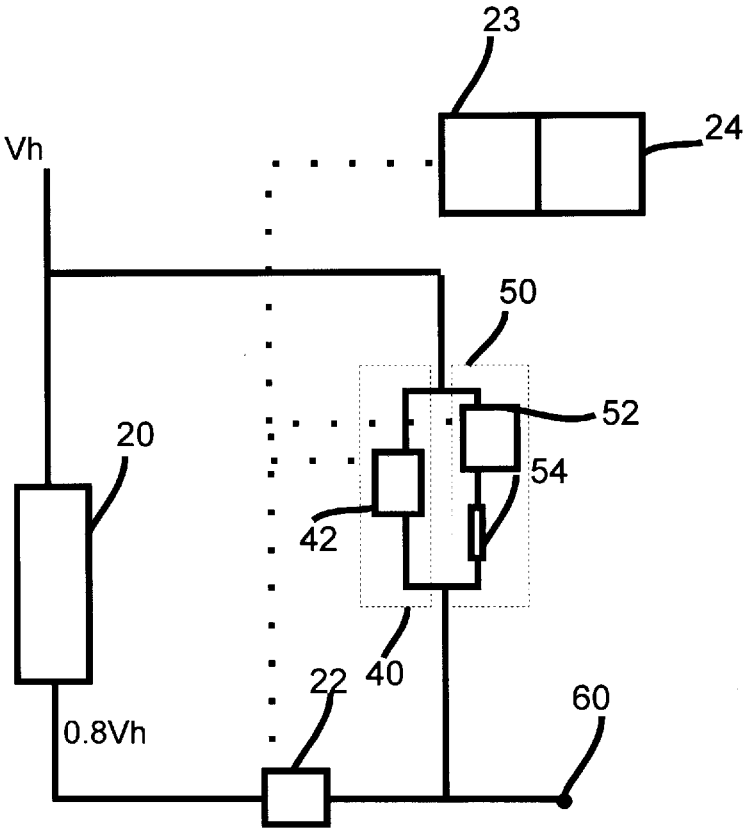
FIG. 1 is a block circuit diagram of a bi-level lighting controller for a lamp operable at two voltage levels.

Referring now to FIG. 1, a circuit is shown comprising a voltage source Vh coupled to provide 600 volts to an input end of an auto-transformer 20. The auto-transformer provides relatively efficient transformation from a higher voltage level to a lower one, and sustains a near perfect sine wave, thereby not inducing unwanted harmonics into the power system. An output of the auto-transformer 20 provides a second voltage level, for example, 80% of the 600 volts, to a switch 22 connected thereto. The switch in its closed position electrically couples the output of the auto-transformer 20 to an output terminal of the device 60 and allows current to flow therethrough. In its opened position, the switch 22 does not electrically couple the output of the auto-transformer to an output terminal of the device 60

Two parallel circuits, 40 and 50, have ends connected to the voltage source Vh and other ends electrically coupled with the output terminal 60. The first circuit 40 has a controllable switch 42 intermediate its end for allowing or preventing current to flow therethrough dependent upon whether the switch is closed or open. The second circuit 50, comprises a controllable switch 52 in series with a resistor 54. Control means in the form of a programmable logic controller (PLC) 23 suitably programmed with timing information to open and close the switches 22, 42, and 52 is coupled with a timing circuit 24 having an internal clock which determines when for example to dim, or to turn on or off a lighting load. This timing circuit automatically provides timing signals to the PLC at predetermined timed intervals. Thus, this circuit functions to provide a relatively smooth voltage transition for controlling lighting or other loads. In an alternative embodiment, the timing circuit 24, may be substituted with a remote energy management system comprising a circuit for receiving control commands to be provided to the PLC from a remote source, so that control of a lighting load can be remotely initiated. Alternatively, the internal clock of the timing circuit 24 may be bypassed and manual override of the timing circuit 24 may be initiated.

In order to power-up the lamps (not shown), switch 42 is closed, while switches 52 and 22 are open, thereby bypassing the auto-transformer 20; Vh (600 volts) is present at the output terminal 60. In this mode, after approximately 25 minutes lamps connected to the output terminal 60 are warmed-up. Once the initial warm-up is completed, the lamps are dimmed when desirable in the following manner. A low light command is issued by the timer 24 and the system executes transition from high to low voltage; the following sequence is executed: after the switch 52 closes the switch 42 opens; the switch 22 closes, and after about 300 ms the switch 52 opens. At this point, the auto-transformer 20 feeds the lighting load at a reduced voltage. A similar concept is applied in the transition from low to high voltage but in reverse order. Switch 52 closes, then switch 22 opens; switch 42 is then closed and switch 52 opens. Once again the full voltage is applied to the lighting load, wherein the closing of the switch 42 effects bypassing the transformer. Each step from high to low and low to high are controlled precisely by the PLC. The timing sequence of instructions executed by the PLC 23 is used to protect the resistor 54 from extensive heat and potential damage, preventing switch 52 from staying on longer then 2 seconds. The value of the resistor 54 is selected in such a manner as to cushion the transition from high to low or low to high voltage. In an exemplary embodiment a resistor value of between 1 and 2 ohms is selected. Functionally, the resistor protects the transformer and the contacts of the switches from an extensive inrush of current during the switch over. In addition, the resistor 54 plays an important role in limiting power to the lighting load before the reduced voltage supply from the transformer 20 is applied to the lighting load.

Figure 2A:
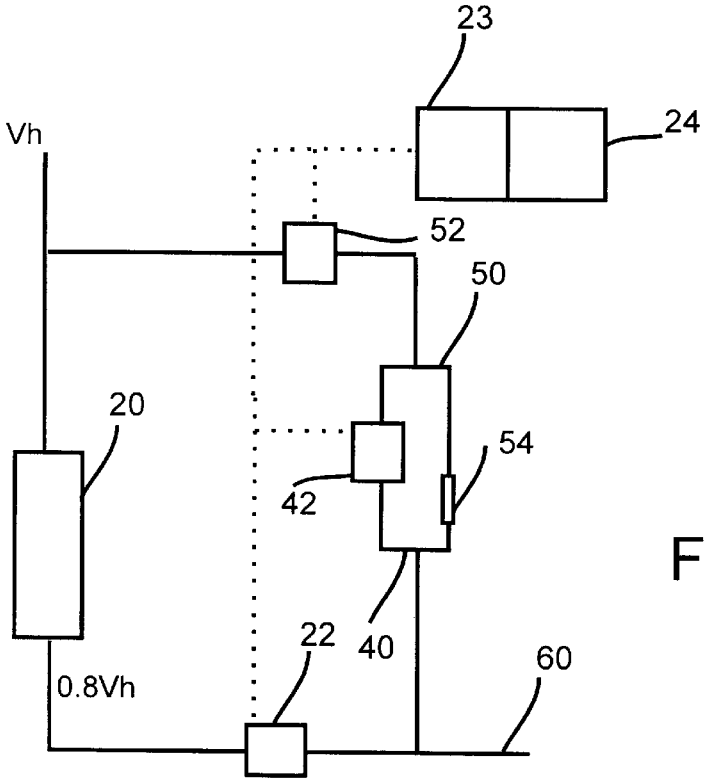
FIG. 2*a* is an alternative embodiment of a block circuit diagram of a bi-level lighting controller.
Figure 2B:
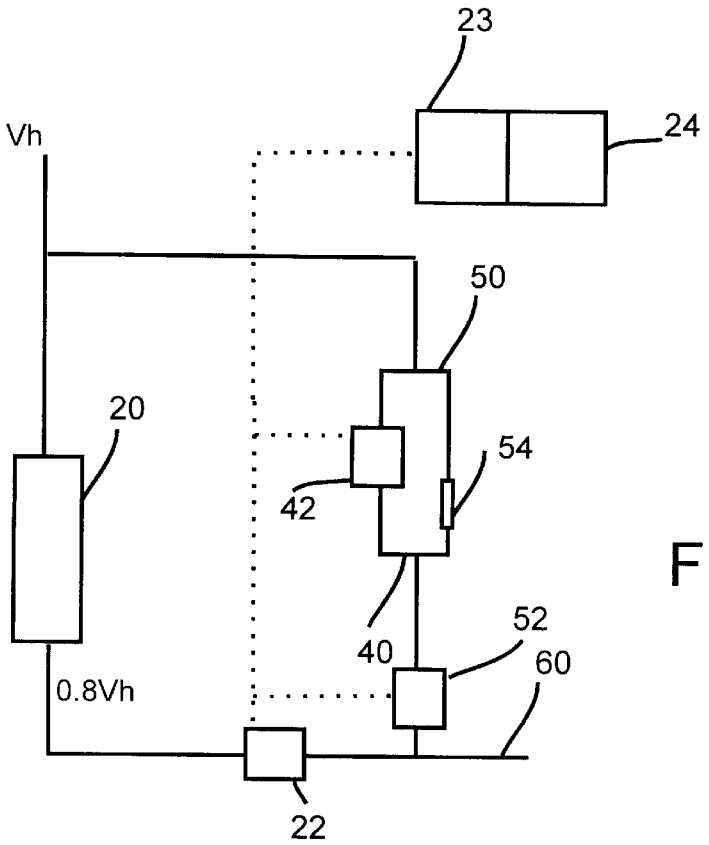
FIG. 2*b* is an alternative embodiment of a block circuit diagram of a bi-level lighting controller; and, FIG. 3 is a block circuit diagram of an alternative embodiment of a bi-level lighting controller for HID lamps wherein three power-up input voltages are supplied.

Turning now to FIGS. 2*a* and 2*b*, alternative embodiments of the invention are shown wherein the switch 52 is disposed along either along the path between the voltage source Vh and the parallel circuits 40 and 50 or alternatively between the parallel circuits 40 and 50 and the output terminal 60. In both of these embodiments upon power up of the device for a transition from high to low, switches 42 and 52 are closed and after the predetermined warm-up interval, switch 42 opens and the current passes through the resistor 54. Similarly, to the aforementioned embodiment, switch 22 is subsequently closed, and after approximately 300 ms, switch 52 is opened. In the embodiments of FIGS. 2*a* and 2*b*, the default state of the switches 42 and 52 may be such that the switches are closed and the switches are opened sequentially as described hereinabove as required to switch from high to low voltage.

Figure 3:
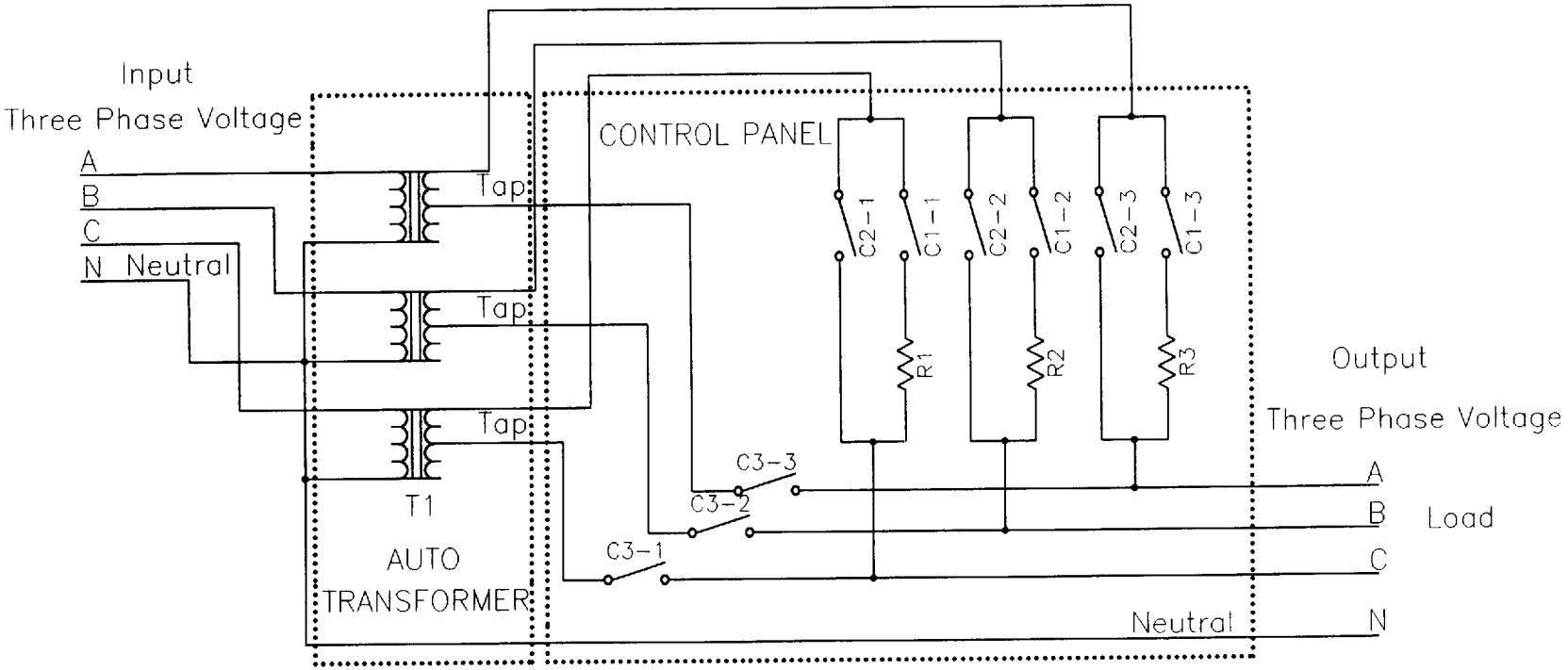
Figure 3:
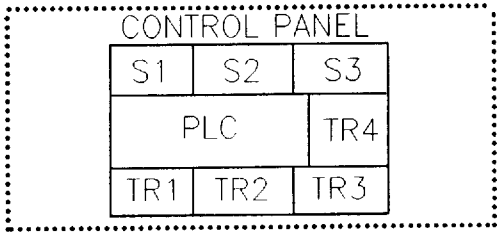

Referring now to FIG. 3, an alternative embodiment of the invention is shown based on the embodiment shown in FIG. 1, wherein three input voltage levels 600, 480, and 380 volts are reduced through a buffered or cushioned transition to 80% of their voltage levels.

The circuit shown is generally controlled by a programmable logic controller (PLC) 22 and a timing circuit 24. The basic circuit is essentially the same as that shown in FIG. 1, however three contactor circuits each comprising a resistor three contactors C1, C2, and C3, and an auto-transformer are provided to yield three output voltages. Alternatively, switching means in the form of contactors C1, C2, and C3, can be replaced with semiconductor switches such as TRIACs or semi-controller rectifiers.

In operation, the lighting system is initialized by the switch S1 and shut off by the switch S2. At start-up (TR2 on), a full three-phase voltage (600,480,380 or any another three phase nominal voltage), is applied via contactor C2 to a lighting load. Contactor C2 is comprised of three switches C2-1, C2-2, and C2-3. The auto-transformer circuit (T1) is by-passed during this mode. After approximately 25 minutes the lamps (not shown) are warmed-up. Once the initial warm-up is completed, the system is ready for dimming lights. Upon issuance of a low light command by the main timer, indicated by TR3 being on, or manual switch S3 being on, or energy management interface wherein RT4 is on, the system executes a transition from high to low voltage. The sequence is as follows: Cl (C1-1, C1-2, C1-3) closes then C2 (C2-1, C2-2, and C2-3) opens then C3 (C3-1, C3-2, C3-3) closes and eventually Cl opens. At this point, the transformer (TI) feeds the lighting load at a reduced voltage from one of the sets of taps. Similarly, however in reverse order, in the transition from Low to High TR3 is off and S3 is off and RT4 is off, Cl closes then C3 opens then C2 closes and last Cl opens. Once again the full voltage is applied to the lighting load and C2 bypasses the transformer. Each step from High to Low or Low to High are controlled precisely by the PLC. TR1 is used to protect the resistors R1, R2 and R3 from extensive heat and potential damage caused when C1 stays on longer than, for example, 300 ms. The resistors R1, R2 and R3 are selected in such a way that they cushion the transition from high to low or low to high. The resistors protect the transformer and the contactor contacts from an extensive inrush of current during the switch over. In addition, the resistors play a crucial role in limiting power to the lighting load before the reduced voltage supply from the transformer is applied to the lighting load; selection of resistors is such that lighting functions are not impeded during a transition from high voltage to low voltage and such that power dissipation by the resistors is limited. It is preferred that no current flows through the resistors R1, R2, and R3 for 2 minutes or more so thereby preventing the resistors from overheating. Thus, a duration of 2 minutes or greater should pass in a high or low state, prior to a transition to the other state.

Of course, numerous other embodiments may be envisaged without departing from the spirit and scope of the invention.

What is claimed is:

1. A circuit for switching an output terminal from a first voltage level to a second voltage level through a buffered transition, the circuit comprising:

a) a first voltage source for providing a first voltage level;

b) a second voltage source for providing a second voltage level;

c) resistive means and first switching means connected in series and electrically coupled between the first voltage source and the output terminal for providing a suitable resistance for buffering a transition from the first voltage level to the second voltage level or the second voltage level to the first voltage level;

d) a second switching means electrically coupled between the first voltage and the output terminal;

e) a third switching means electrically coupled between the second voltage source and the output terminal;

f) control means for controlling the three switches in a predetermined sequence to allow switching from the first source to the second source through a buffered transition provided by the resistive means.

2. A circuit as defined in claim 1, wherein the second voltage source is coupled with the first voltage source for receiving the first voltage level and for transforming it to the second voltage level.

3. A circuit as defined in claim 1, further comprising stored executable instructions for providing timing information to the control means, to effect the execution of the predetermined sequence.

4. A circuit as defined in claim 3 wherein the execution of the stored executable instructions effect a series of indications at timed intervals to the control means and wherein opening and closing of first, second, and third switching means is actuated in dependence upon the indications and in a predetermined order.

5. A circuit as defined in claim 4, wherein the control means are responsive to commands received from a remote source.

6. A circuit as defined in claim 1, wherein the control means is for closing the first switching means prior to a transition between the first voltage source and the second voltage source and for opening the first switching means upon completion of the transition.

7. A circuit as defined in claim 6, further comprising timing means for providing timing information to the control means, said timing information corresponding to the switching on, switching off, and dimming of a load being or to be powered by the circuit.

8. A method for switching an output terminal from a first voltage level to a second level through a buffered transition, comprising the steps of:

a) providing a first voltage source for providing a first voltage level;

b) providing a second voltage source for providing a second voltage level;

c) electrically coupling the first voltage source to the output terminal to provide the first voltage level at the output terminal;

d) after a suitable duration for warming up a load, buffering a transition from the first voltage level to the second voltage level by switching means for resisting or limiting current into the circuit between the first voltage source and the output terminal, and allowing current to pass through the means for resisting or limiting current for a predetermined interval of time while decoupling the first voltage source from being directly coupled to the output terminal; and, e) switching to electrically couple the second voltage source to the output terminal to provide the second voltage level at the output terminal.

9. A method as defined in claim 8, wherein the switching of the output terminal from a first voltage level to a second voltage level is performed only after substantially no current has passed through the resistive means for approximately 2 minutes or more.

10. A method for switching an output terminal from a first voltage level to a second level through a buffered transition, comprising the steps of:

a) providing a first voltage source for providing a first voltage level;

b) providing a second voltage source for providing a second voltage level;

c) electrically coupling the first voltage source to the output terminal to provide the first voltage level at the output terminal;

d) after a suitable duration for warming up a load, buffering a transition from the first voltage level to the second voltage level by changing the state of a switch to allow current provided by the first voltage source to flow through means for resisting or limiting current between the first voltage source and the output terminal, and allowing the current to pass through the means for resisting or limiting current for a predetermined interval of time while decoupling the first voltage source from being directly coupled to the output terminal; and, e) switching to electrically couple the second voltage source to the output terminal to provide the second voltage level at the output terminal.

* * * * *